US006050303A

United States Patent [19]

Corbiere

[11] Patent Number: 6,050,303

[45] Date of Patent: Apr. 18, 2000

[54] METHOD FOR ENHANCING THE WEAVING OF A WARP YARN FABRIC HAVING A HIGH MODULUS OF ELASTICITY

[75] Inventor: Claude Corbiere, La Tour de Salvagny, France

[73] Assignee: Corbiere S.A., France

[21] Appl. No.: 09/202,306

[22] PCT Filed: Jul. 3, 1997

[86] PCT No.: PCT/FR97/01189

§ 371 Date: Dec. 14, 1998

§ 102(e) Date: Dec. 14, 1998

[87] PCT Pub. No.: WO98/03709

PCT Pub. Date: Jan. 29, 1998

[30] Foreign Application Priority Data

Jul. 18, 1996 [FR] France ..... 96.09264

[51] Int. Cl.[7] ..... D03D 41/00; D03D 9/00

[52] U.S. Cl. ..... 139/1 R; 139/11; 139/35

[58] Field of Search ..... 139/1 R, 11, 35; 264/164

[56] References Cited

U.S. PATENT DOCUMENTS 3,772,872 11/1973 Piazza et al. .
4,024,003 5/1977 Buhler .

*Primary Examiner*—John J. Calvert
*Assistant Examiner*—Robert H. Muromoto, Jr.
*Attorney, Agent, or Firm*—Wall Marjama Bilinski & Burr

[57] ABSTRACT

A method for enhancing the weaving of a warp yarn fabric having a high modulus of elasticity in which a sheet of parallel warp yarns is continuously unwound from a beam. The sheet is fed over a whip roll and a shed is formed using healds, the shed being defined in the forward direction of the warp by a shed opening point on an inlet side and a fell point on an opposite side. A weft yarn is inserted into the shed to form a resulting fabric which is evenly pulled and wound. The warp yarns are sufficiently heated in an area adjacent to the shed opening point to cause a local reduction in the modulus of elasticity of the warp yarns. Subsequently, the warp yarns are cooled in the shed before reaching the healds.

9 Claims, 1 Drawing Sheet

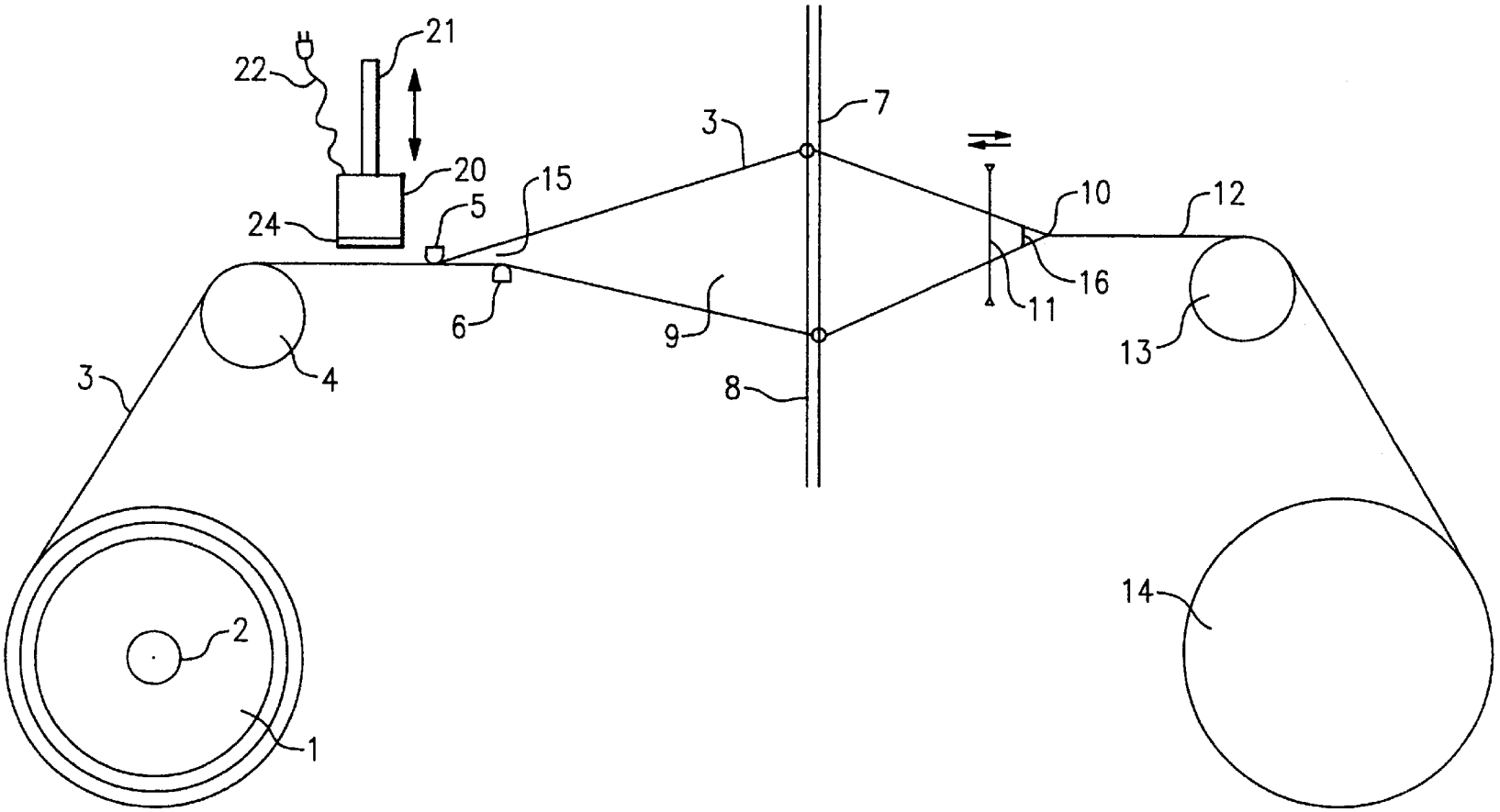
1
2
3
4
5
6
7
8
9
10
11
12
13
14
15
16
20
21
22
24

METHOD FOR ENHANCING THE WEAVING OF A WARP YARN FABRIC HAVING A HIGH MODULUS OF ELASTICITY

FIELD OF THE INVENTION

The invention relates to the field of textile weaving and, more specifically, to a method making it possible to improve the weaving of a fabric of warp yarns having a high modulus of elasticity.

BACKGROUND OF THE INVENTION

As is known, in a conventional weaving loom, the warp yarns are unwound from a beam and then pass over a back-rest roller. Downstream of the latter, depending on the selected weave, the various parallel warp yarns are drawn alternately upwards and downwards in order to form the shed. The various warp yarns subsequently meet again at the fell point, where the comb beats up the cloth after each weft insertion.

Within the shed, the yarns are drawn upwards and downwards by means of healds. It will easily be appreciated that these warp yarns drawn in this way undergo mechanical stresses whenever the shed opens. These stresses lay the yarns very firmly onto their successive guides (yarn guides, shield eyes, comb, etc.), thus causing fraying and bringing about yarn breaks which bring the weaving loom to a stop, thus slowing the actual production speed and impairing the uniformity of the cloth obtained.

Some designers of weaving looms attempt to reduce the stresses imparted to the yarns by giving the back-rest roller a reciprocating movement in synchronism with the opening of the shed. Unfortunately, the considerable weight of the back-rest roller and, consequently, its high inertia reduces mobility, the more so because the beating-up frequency is high.

It will be appreciated that the mechanical stresses which the yarns undergo are the greater the higher the beating-up speeds. Thus, it was found that, for high-speed weaving looms, that is to say mainly those in which the weft yarn is driven by water jet or air jet, it is difficult to exceed the speed of 1000 to 1200 beats per minute, without seeing signs of serious damage to the warp yarns and a large number of breaks, the more so because the warp yarns have a high modulus of elasticity.

This phenomenon, which is the more pronounced, the more rigid the warp yarns are, gives rise, in particular, to more frequent malfunctions during the weaving of polyester than during the weaving of polyarnide.

The invention therefore attempts to solve the problem of warp yarn breaks following high mechanical stresses experienced by the yarns at the moment the shed opens and, as a consequence, to increase the beating-up speed of the looms, whilst at the same time maintaining the same weaving quality.

SUMMARY OF THE INVENTION

The invention relates to a method for improving the weaving of a fabric comprising warp yarns having a high modulus of elasticity, in which:

- a layer of parallel warp yarns is unwound continuously from a beam;
- the said layer is passed over a back-rest roller;
- a shed is formed by means of healds, the said shed being defined, in the direction of advance of the warp, by a shed opening point at the entrance and by a fell point on the other side;
- a weft yarn is inserted into the shed in the vicinity of the fell point in order to form a fabric;
- and finally, the fabric thus formed is pulled and wound uniformly.

This method is characterized in that, in the vicinity of the opening point of the shed, the warp yarns are heated to a temperature sufficient to bring about a local reduction in the modulus of elasticity of the warp yarns, followed by cooling of the warp yarns in the shed before they reach the healds.

As defined herein modulus of elasticity (or Young's modulus) means the leading coefficient (or the slope of the origin) of the curve which gives, on the ordinate, the pulling force and, on the abscissa, the elongation which this force causes. This modulus is expressed in newtons/tex or in gigapascals (GPa). As an example, the modulus of elasticity of cold polyester yarns is of the order of 10 GPa for textile yarns having high residual elongation or elongation at break (greater than 35%). It may reach 15 GPa for high-strength yarns with low residual elongation (of the order of 15%). By way of comparison, the Young's modulus of polyarnide yarns is of the order of 5 GPa. In both cases, heating beyond the second-order transition temperature causes a considerable reduction in the modulus of elasticity when the yarn is then stretched. Typically, the modulus of elasticity under hot conditions may decrease, and, in some cases, reaches one tenth of the modulus under cold conditions.

In other words, the invention involves heating the warp yarns at the opening point of the shed, so as to reduce their modulus of elasticity in order to make them more flexible and, more specifically, in order to allow them, in the region of entry into the shed, to absorb the pulsed increases in tension which are attributable to the movements of the healds.

In general terms, at low speeds of advance, cooling takes place by natural convection, but the invention also embraces the variants in which additional means of any kind are used to make cooling easier.

Furthermore, if the warp yarns are thermoplastic and therefore have a softening temperature (TR) and a melting point (TF), the warp yarns are advantageously heated to a temperature between the softening temperature (TR) and the melting point (TF) of the warp yarns. Thus, in some cases, heating the warp yarns makes it possible to cause stretching, while at the same time limiting the tension to which these yarns are subjected during the opening of the shed, thereby reducing the risks of breakage.

Thus, according to the invention, these warp yarns are stretched in the heated zone as a result of the intermittent pull imparted to them by the movement of the healds, said pull being combined with the uniform take-up of the winding of the cloth. Surprisingly, the intermittent stretching of the yarns which is carried out in this way does not, as could have been foreseen, give rise to irregularities in the warp yarns and therefore in the cloth. Quite to the contrary, an improvement is found in the uniformity of the yarns processed in this way, in terms of both linear density and dyeing affinity.

In practice, heating takes place either by convection or by radiation or by contact.

In a practical embodiment, heating is carried out by contact, by means of a heating pad protected from abrasion by a chromium-plated or ceramic covering. In other words, before entering the shed, or just on entering the latter, the warp yarns burst by sliding on a heating element, of which the length, counted in the direction of passage of the yarn, is calculated in order to cause the desired increase in temperature within the yarns, this being as a function of the speed of advance and of the size of the yarns.

Advantageously, in practice, the pad is combined with means making it possible to move the yarn layer away when the weaving loom stops. Thus, as soon as the warp yarns have stopped, the heating pad is moved away from the warp yarns in order to avoid causing damage to these, or even melting them in an extreme case.

Advantageously, the heating pad is located above the warp in order to avoid residual heating by convection when the pad is being moved away.

In a preferred embodiment, the device for moving away the heating pad operates by default, that is to say it moves the pad away automatically as soon as the advance of the yarn stops, whether after a downstream yarn break or after a failure in the supply of electricity or compressed air to the various members of the installation.

In a preferred embodiment, the heating pad is arranged in a zone contained between the back-rest roller and leasing guides arranged in the vicinity of the back-rest roller and defining the opening points of the shed. Thus, heating is obtained uniformly for all the yarns brought together in a plane zone where they are all parallel.

This method makes it possible to process a large number of chemical yarns, for example polyarnides, polyester and, advantageously, partially oriented yarns, commonly called "POYs", such as, in particular, those described in the Patents U.S. Pat. Nos 3,771,162 and 3,772,872. In fact, the weaving method according to the invention makes it possible to achieve stretching of the yarn and thus executes, in a single step, the two operations of characteristic intermittent stretching and weaving. Previously, and, in order to obtain a POY-based cloth, conventional uniform drawing has been carried out beforehand, followed, completely independently, by weaving.

It also makes it possible to process yarns for industrial use, such as, for example, glass or steel yarns.

BRIEF DESCRIPTION OF THE DRAWINGS

The way in which the invention is implemented and the advantages which arise from it will emerge clearly from the description of the following figure. FIG. 1 is the circuit along which the warp yarns run within a weaving loom in accordance with a preferred embodiment of the invention.

DETAILED DESCRIPTION OF THE INVENTION

As already stated, the invention relates to a method for improving the weaving of warp yarns having a high modulus of elasticity. This method may be employed on a conventional weaving loom, to which are added elements making it possible to carry out the characteristic function of the method.

Thus, the conventional weaving loom has, in the direction of run of the yarn, a beam (1) which is mounted on a shaft (2) and on which all the parallel warp yarns are wound. These warp yarns (3) are unwound from the beam (1) as far as a back-rest roller (4), from which they assume a substantially horizontal direction. In a particular embodiment, these warp yarns (3) subsequently pass between two leasing guides (5, 6). Beyond these leasing guides (5, 6), they are taken up by healds (7, 8), the purpose of which is to move the various warp yarns (3) upwards or downwards in order to form the shed (9) and make it possible to insert the weft yarn (16). After the healds (7, 8), the warp yarns meet again at the fell point (10), onto which the comb (11) beats up after each reopening of the shed. Beyond the fell point, the cloth (12) thus formed passes by way of various transfer rollers (13) in order to end up at the winding system (14).

As already stated, the invention involves heating the warp yarns in the vicinity of the opening point of the shed, in order to reduce their modulus of elasticity and, if appropriate, allow them, as a result of the action of the loom, to undergo intermittent stretching just before actual weaving. As already stated, the intermittent stretching results in a uniformity of the cloth, which is an unexpected effect and explains the fact that it has not been sought hitherto.

Thus, various means may be suitable for ensuring this heating. In the embodiment illustrated, there is a heating pad (20) which is present over the entire width of all the warp yarns and which can come into contact with the layer of warp yarns between the back-rest roller (4) and the leasing guides (5, 6). More specifically, there is a transverse heating element, the lower face of which is covered with a material having very high surface hardness and a low coefficient of friction, in order to prevent any abrasion by the warp yarns which would cause subsequent damage to the warp yarns themselves. There may be, in particular, an outer chromium-plated or ceramic coat (24).

Of course, the invention embraces all types of heating of the pad, particularly those employing electrical energy, by means of suitable connections (22).

As already stated, the pad (20) may be combined with means (21) making it possible to position the pad (20) in contact with the warp yarns (3) and, above all, to withdraw this pad if the machine stops, the purpose of this being to prevent the yarns from being damaged, or even melted in an extreme case. These may be purely mechanical means or those preferably acting by means of hydraulic jacks, or even electromechanical systems. Preferably, the position of rest of the pad is away from the yarn layer, in such a way that, in the event of a breakdown of the moving-away means, the pad does not remain in contact with the yarns, but, on the contrary, automatically moves away from these.

Preferably, the pad is positioned above the yarn layer.

Of course, the invention is not limited to the embodiment illustrated, in which heating is carried out upstream of the leasing guides (5, 6), but also embraces the variants in which heating takes place in the vicinity of or just after these.

Moreover, the method may be carried out with the aid of a heating pad, of which the contact zone with the yarns is a few centimeters, but also with the aid of means operating by radiation or by convection, in which the heating element does not come directly into contact with the warp yarns.

As already stated, in the particular case of thermoplastic yarns, the invention involves raising the temperature of the yarn beyond its transition temperature, but below the melting point. Thus, with regard to the processing of polyarnide (6—6), it was seen that the result was useful if the temperature was of the order of 180° C. to 200° C. As regards polyarnide 6, this temperature is 170° C. to 190° C. Where polyester is concerned, this temperature is in the neighborhood of 200° C. to 220° C.

Serimetric tests were conducted on unwoven warp yarns from a fabric produced, on the one hand, according to the method and, on the other hand, without the characteristic heating of the invention being carried out. Thus, it is seen that the strength of the processed yarns according to the invention is markedly increased, typically by 10% for already stretched yarns and by more than 100% for POYs. Additionally, excellent uniformity of the yarns in terms of both linear density and dyeing affinity is found.

Furthermore, elongation at break is reduced and may, for example, go from 60 to 40% for yarns previously stretched. In the particular case of a POY, the elongation at break (or residual elongation) may go from 400% before stretching to 50% after stretching. Finally, the spread relating to this elongation at break is greatly reduced, by a factor of 5, thus corresponding to homogenization of the qualities of the warp yarns. This homogenization is also seen in terms of dyeing affinity, the uniformity of which is improved.

It may be gathered from the foregoing that the method according to the invention proves advantageous on different levels. Thus, the processing of the yarn during weaving makes it possible to increase the operating speed by more than 20%, that is to say, typically, making it possible to go from 1000 beats per minute to more than 1200. Furthermore, weaveability, that is to say performance, is increased and typically goes from 95% to 97% or even 98%, this increase in performance being all the more appreciable because it is combined with the fact that the beating-up speed is likewise increased.

What is claimed is:

1. A method for improving the weaving of a fabric of warp yarns having a high modulus of elasticity, said method including the steps of:

unwinding a layer of parallel warp yarns continuously from a beam;

processing said layer over a back-rest roller;

forming a shed by means of healds, said shed being defined, in the direction of advance of the warp, by a shed opening point at the entrance thereof and by a fell point on an opposite side;

inserting a weft yarn into the shed in the vicinity of the fell point in order to form a fabric;

heating the warp yarns in the vicinity of the opening point of the shed to a temperature sufficient to cause a local reduction in the modulus of elasticity of said warp yarns;

cooling said warp yarns in the shed following said heating step before said yarns reach the healds; and pulling and winding the formed fabric uniformly.

2. A method as recited in claim 1, wherein the warp yarns have a softening temperature and a melting point, wherein the method includes the steps of:

heating the warp yarns during said heating step to a temperature between the softening temperature and the melting point of said yarns; and stretching the warp yarns by intermittent pulling in the heated zone.

3. A method as recited in claim 2, wherein the warp yarns are partially oriented yarns (poys).

4. A method as recited in claim 1, wherein said heating step takes place by one of the group consisting of convection, radiation and contact.

5. A method as recited in claim 1, wherein said heating step includes the step of heating by contacting said warp yarns using a heating pad protected against abrasion by a covering which is one of ceramic and chromium.

6. A method as recited in claim 5, including the step of locating the heating pad above the yarn layer prior to heating.

7. A method as recited in claim 5, including the step of combining said heating pad with means enabling the yarn layer to move away from said pad when the beam stops.

8. A method as recited in claim 7, including the step of moving the yarn layer relative to said heating pad when the yarn layer is at rest.

9. A method as recited in claim 5, including the step of arranging said heating pad in a zone contained between the back-rest roller and leasing guides which are arranged in the vicinity of the backrest roller for defining the shed opening point.

* * * * *